US006478192B2

(12) United States Patent
Heyes

(10) Patent No.: US 6,478,192 B2
(45) Date of Patent: Nov. 12, 2002

(54) DILUENT CHANGE OVER DISPENSE APPARATUS

(75) Inventor: Keith Heyes, Barnt Green (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/819,442

(22) Filed: Mar. 28, 2001

(65) Prior Publication Data

US 2002/0023935 A1 Feb. 28, 2002

(51) Int. Cl.[7] ..... B65D 5/06

(52) U.S. Cl. ..... 222/144.5; 222/129.1; 222/504; 137/625.3

(58) Field of Search ..... 222/1, 59, 129.1, 222/144.5, 504; 137/625.3, 625.4

(56) References Cited

U.S. PATENT DOCUMENTS

| | | | | |
|---|---|---|---|---|
| 2,516,825 A | | 7/1950 | Hejduk et al. | |
| 2,748,982 A | | 6/1956 | Copping | |
| 3,073,349 A | | 1/1963 | Mitchell | |
| 3,110,320 A | | 11/1963 | Rosenberger | |
| 3,503,540 A | * | 3/1970 | Fuerst | 222/129.1 |
| 3,695,290 A | | 10/1972 | Evans | |
| 3,851,668 A | | 12/1974 | Benjamin | |
| 3,955,794 A | | 5/1976 | Hankosky | |
| 4,108,134 A | * | 8/1978 | Malec | 123/196 |
| 4,753,370 A | * | 6/1988 | Rudick | 222/105 |
| 4,979,639 A | * | 12/1990 | Hoover et al. | 222/1 |
| 5,984,142 A | * | 11/1999 | Castaldi | 222/129.1 |
| 6,253,963 B1 | * | 7/2001 | Tachibana | 222/129.1 |
| 6,286,721 B1 | * | 9/2001 | Pellegrini | 222/129.1 |

* cited by examiner

*Primary Examiner*—Henry C. Yuen
*Assistant Examiner*—Melvin A. Cartagena
(74) *Attorney, Agent, or Firm*—Sten Erik Hakanson

(57) ABSTRACT

A post mix beverage dispense apparatus has a mixing head 10 arranged to receive different combinations of a concentrate and a diluent for dispensing any selected one of a range of beverages. The concentrates are delivered to the head 10 in dedicated flow lines 14, 16, 18, 20 under the control of respective valves 22, 24, 26, 28 actuated via a control board 52 in response to user selection of a desired beverage at a control panel 50. The diluent is delivered to the head 10 in a flow line 30 under the control of a changeover valve 32 for selectively correcting sources of different diluents to the flow line 30 via the control board 52 in response to user selection of the desired beverage at the control panel 50. The changeover valve 32 is positioned close to the mixing head 10 to minimise the volume of diluent remaining between the valve 32 and the head 10 after dispense. In a preferred arrangement, a control valve 38 is provided between the changeover valve 32 and the head 10 for providing a metered flow of diluent.

5 Claims, 5 Drawing Sheets

Fig.-1
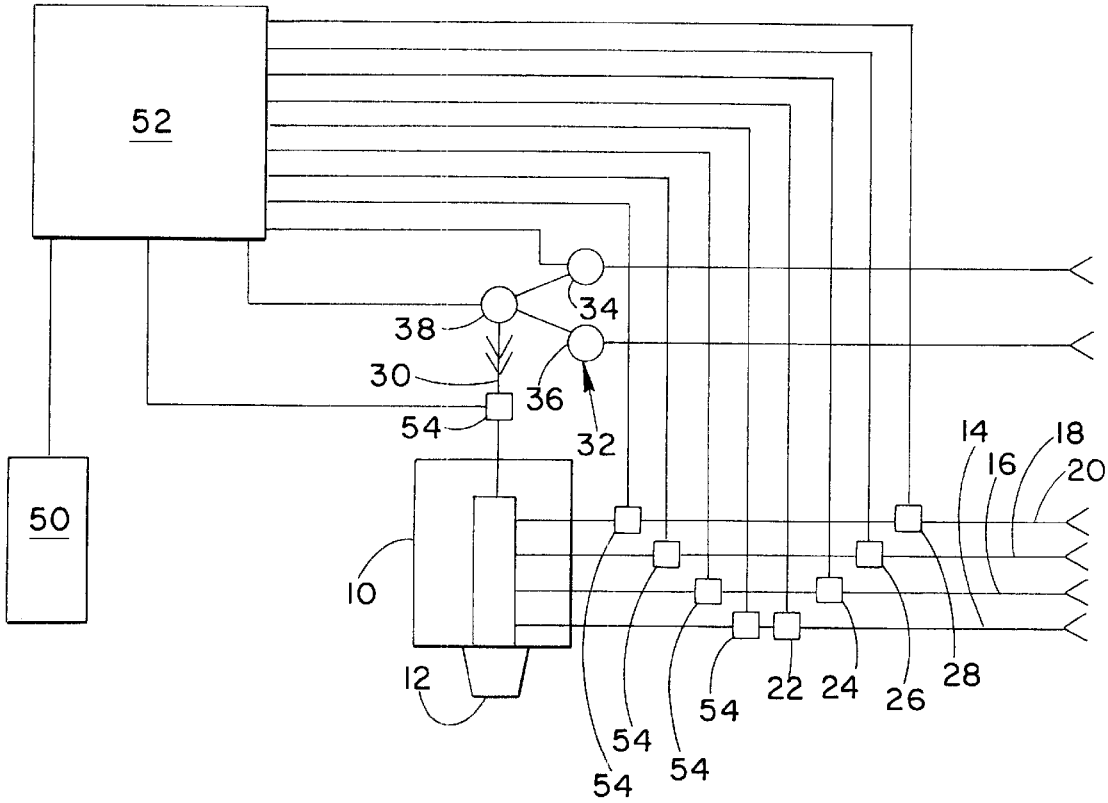
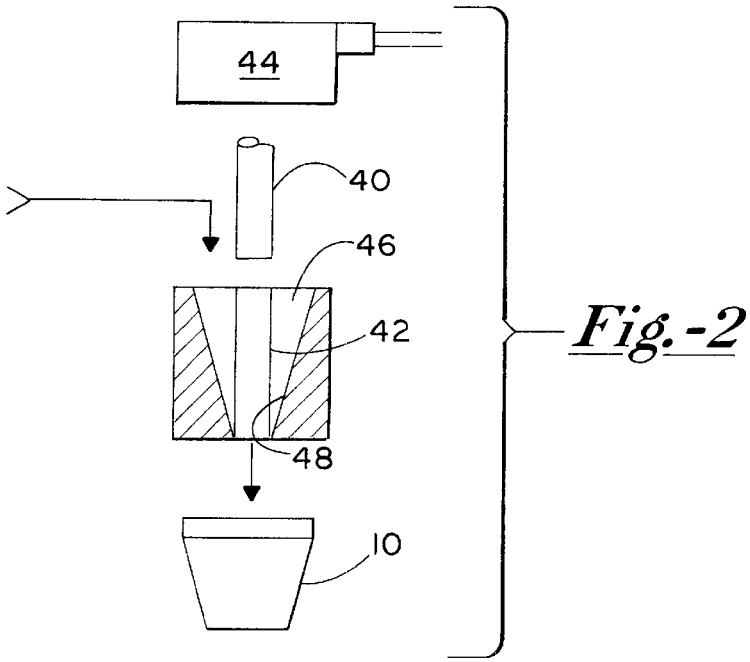
Fig.-2

DILUENT CHANGE OVER DISPENSE APPARATUS

BACKGROUND OF THE INVENTION

This invention relates to a dispense apparatus. It is particularly concerned with beverage dispense apparatus for post-mix beverages, i.e. beverages comprising a diluted concentrate, e.g. a syrup or cola, in which the concentrate is mixed with a diluent, usually water, at the point of dispense.

SUMMARY OF THE INVENTION

Accordingly, the present invention provides a beverage dispense apparatus comprising a mixing head in which a concentrate and a diluent may be mixed, means to deliver the diluent and the concentrate separately to the mixing head, an outlet nozzle from the mixing head, and a diluent changeover valve means upstream of the mixing head for selectively connecting the mixing head to a source of a first diluent and a source of a second diluent, and the diluent changeover valve means being positioned adjacent the mixing head.

The first diluent is preferably still water and the second diluent is preferably carbonated water and the invention will for convenience be more specifically described below with references to those diluents. By means of the changeover valve means a choice of carbonated and noncarbonated post-mix beverages may be provided by connecting the required source of diluent to the mixing head through one flow line. Because the changeover valve means is situated close to the mixing head, the amount of one diluent that remains in the flow line between the valve means and the head after a dispense is minimised so that its mixing in with a subsequent beverage dispensed using the other diluent has little or no noticeable effect.

In its simplest form, the apparatus can dispense still or carbonated post-mix beverages using one concentrate. More preferably, the apparatus can dispense a plurality of still or carbonated post-mix beverages using a plurality of concentrates. One or more concentrates may be supplied to the mixing head from its own source by conventional means and is mixed there with either carbonated or still water as required in response to a command signal for a specific beverage. Thus, for example, if an apparatus having a choice of four concentrates is used, a total of eight different beverages may be dispensed utilising only one changeover valve means for the water supply, one mixing head and dispense nozzle and one set of electronic controls including one keypad by means of which the required beverage is ordered for dispense. Of course, there will also need to be means to supply each of the concentrates from its source to the mixing head.

Where more than four concentrate flavors are required, for example six or eight concentrates, it may be found desirable to have two water supply valves, one being dedicated to carbonated water supply and the other having the changeover valve means connectable in turn to a source of carbonated water and to a source of still water. As the majority of beverages dispensed are normally carbonated, two changeover valve means will not normally be required. This apparatus may also conveniently have two mixing heads, each with its own nozzle, and two sets of electric controls and keypads rather than dispensing a large number of different beverages by means of a single nozzle and control unit which has less flexibility in operation.

In a preferred arrangement, a water control valve is provided between the mixing head and the changeover valve means. The water control valve is preferably adjustable between open and closed conditions to provide a selected flow. In this way the required amount of water can be supplied to the mixing head by connecting the appropriate water source via the changeover valve means for a predetermined time. With this arrangement, one water control valve can be employed for both the still and carbonated water supplies, thereby avoiding the cost of separate water control valves, valve adjustment means and, where required a flow meter for each water supply.

The diluent flow control valve is preferably a valve of the type described in International patent application no. PCT/GB98/03564 (WO99/29619), which application is incorporated herein by reference thereto. The particular flow control valeincludes a substantially rigid housing containing a passageway between an inlet and an outlet of the valve and a closure member moveable in the passageway from a first position in which the valve is fully closed to a second position in which the valve is fully open. The wall of the passageway or the closure member define at lease one groove, having a transverse cross-section that increases in area in the downstream or upstream direction of flow. In this way, movement of the closure member from the first, closed position towards the second, open position opens a flow channel through the groove the area of which varies according to the position of the closure member to adjust the flow. The groove(s) may be, for example, of tapering V-shape and will, for convenience, hereafter be referred to as "V-grooves" and the valves of this general type as "V-groove valves", although it will be appreciated that the grooves may, if desired, have a different tapering cross-section, e.g. of circular, rectangular or other shape.

The progressive increase or decrease in area of the groove flow channels can produce excellent linear flow through these V-groove valves, i.e. for a given pressure the flow rate is more directly proportional to the valve position than for conventional valves. This enables better control of the flow rate over the entire operating range of the valve. The water control valve, particularly when it is a V-groove valve, is preferably provided with a setting mechanism in the form of a stepper motor, e.g. of the pulsed magnetically driven type, whereby the water control valve may be set to an appropriate opening for the required dispense. Alternatively, a lever mechanism, a proportional solenoid actuator or a diaphragm operated mechanism may be used to set the water control valve to the required position.

The concentrate control valves may be any suitable type of valve which the skilled person will readily be able to determine for the concentrates being used. For example, a simple on/off valve that automatically closes on losing power, e.g. with solenoid valve control. The changeover valve means may be, for example, a solenoid valve or a spool valve or any other suitable valve that may be connected in turn to one or other of the diluent supply sources.

A flow meter, e.g. a flow turbine, may be connected into the diluent supply line, preferably downstream of the changeover valve means so that only one meter is required for both diluents. If desired, a flow meter may also be positioned in each concentrate flow line. The flow meter or meters may then be connected to a control means preprogrammed to allow a certain volume or time of flow for each beverage to be dispensed. The control means, when a particular required dispense is signalled, will also open the control valves to the desired degree, monitor the flow and then shut off the valves when the necessary amount of dispense has taken place.

When the water control valve is a V-groove valve as described above, the control means preferably delays the opening of the concentrate control valve for a short period until its opening of the V-groove valve has allowed the closure member of that valve to reach the desired position.

In the event of a power failure or other fault during a dispense, as indicated above, the preferred concentrate control valve will close automatically. Where the water control valve is a V-groove valve, a battery power back-up system may be required in order to close the valve. Alternatively, and more preferably, instead of the battery back-up, the changeover valve means may be arranged to close automatically if a power failure or other fault arises during dispense. Thus, when the changeover valve means comprises two solenoid valves, one for the still water and the other for the carbonated water, whichever diluent is flowing through its respective open solenoid valve when a power failure occurs, that valve will shut off to stop flow although the V-groove control valve will remain open.

The apparatus of the invention also enables carbonated beverages to be dispensed having a range of carbonation levels. This is achieved by using the changeover valve means to dispense first one of the diluents and then the other diluent. The proportion of mixed diluents in the beverage can be varied over the whole range from 100% carbonated water to 100% still water.

DESCRIPTION OF THE DRAWINGS

A better understanding of the structure, function, operation and the objects and advantages of the present invention can be had by reference to the following detailed description which refers to the following figures, wherein:

FIG. 1 shows a diagrammatic representation of one form of beverage dispense apparatus according to the invention.

FIG. 2 shows a diagrammatic representation of .one form of the diluent control valve.

DETAILED DESCRIPTION OF THE PREFERRED EMBODIMENTS

Figure 3:
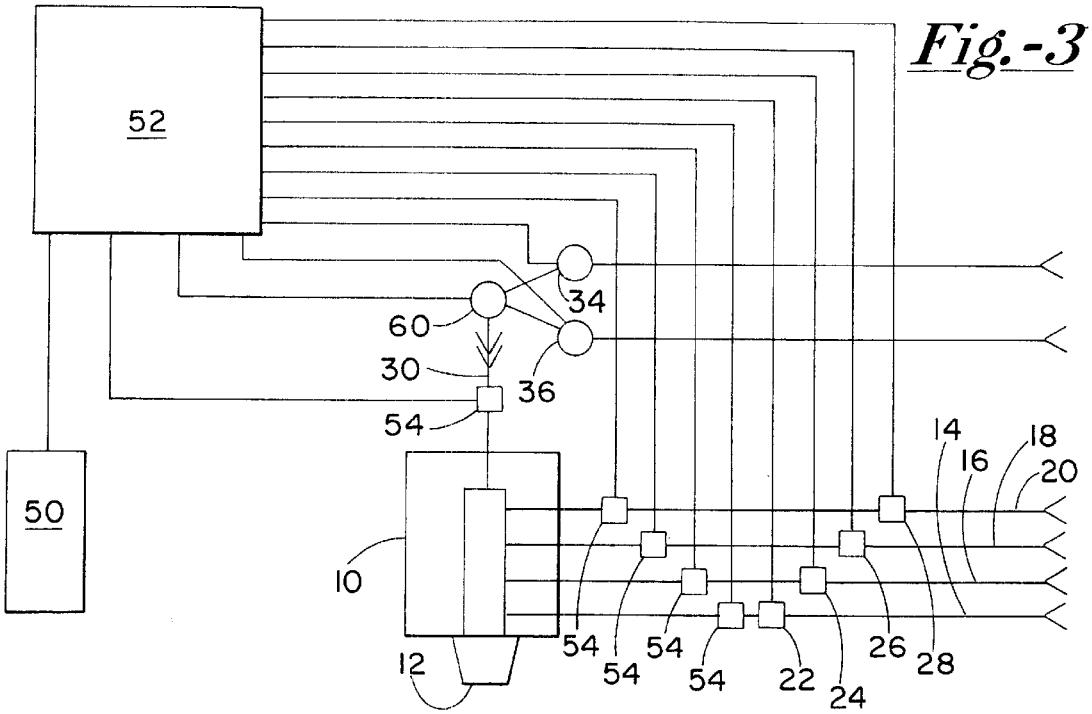
FIG. 3 shows a diagrammatic representation of a second embodiment of the present invention.

FIG. 1 shows schematically the layout of a post-mix beverage dispense apparatus of the present invention. The apparatus has a mixing head 10 with an outlet 12 through which a mixed beverage can be dispensed. The beverage is produced by mixing a concentrate and a diluent in the mixing head 10. In this embodiment, the mixing head is connected via dedicated flow lines 14, 16, 18, 20 to the sources of four different concentrates. Each flow line 14, 16, 18, 20 includes a solenoid control valve 22, 24, 26, 28 for controlling the supply of concentrate to the mixing head 10. It will be understood, however, that the number of flow lines may be altered to connect the mixing head 10 to any desired number of sources of concentrate.

The concentrates may be of any suitable type, for example different flavoured syrups. Concentrate flow is indicated by single-headed arrows and each source of concentrate is supplied to its solenoid control valve 22, 24, 26, 28 by conventional means. The solenoid control valves 22, 24, 26, 28 are of the on/off type arranged to close automatically to cut-off the supply of the concentrate to the mixing head 10 if a fault occurs, for example in response to loss of power.

The mixing head 10 is also connected via a flow line 30 to changeover valve means 32 for selectively connecting the flow line to separate sources (not shown) of two different diluents. In this embodiment, the changeover valve means 32 comprises a respective solenoid control valve 34, 36 for each diluent. It will be understood that the changeover valve means 32 may selectively connect the mixing head 10 to any desired number of diluents.

The diluents may be of any suitable type, for example still or carbonated water. Diluent flow is indicated by double-headed arrows and each source of diluent is supplied to its solenoid control valve 34, 36 by conventional means. In this embodiment, the solenoid control valve 34 controls the supply of still water to the mixing head 10 and the solenoid control valve 36 controls the supply of carbonated water to the mixing head 10. The solenoid control valves 34, 36 are also of the on/off type arranged to close automatically to cut-off the supply of the diluent to the mixing head 10 if a fault occurs, for example in response to loss of power.

Downstream of the changeover valve means 32, a diluent control valve 38 is provided in the flow line 30 for controlling the flow rate so that the required volume of diluent can be accurately dispensed by closing the solenoid control valve 34, 36 of the selected diluent a pre-determined time after it has been opened. The diluent control valve 38 may be of any suitable type such as a V-groove valve. A typical example of such a valve is shown in FIG. 2 and has a piston 40 movable to the right or left into and out of a central through passageway 42 under the control of an actuator 44 to control the flow of diluent through the valve. The actuator 44 may be a stepper motor. The valve 38 is shown in the fully open position in FIG. 2 and the direction of flow of diluent through the valve 38 is indicated by the arrow A. The passageway 42 has a pair of V-grooves 46 opposed across the passageway 42. The cross-section of the grooves 46 narrows in the direction of flow of diluent through the valve 38. When the piston 40 is moved to the right as viewed in FIG. 2, the cross-section of the passageway 42 and hence the flow is reduced. When the piston 40 is fully extended it mates with the internal walls 48 of the passageway 42 beyond the narrow end of the V-grooves 46 to close the valve 38. When the piston 40 is moved to the left from its fully extended position, the valve 38 opens and the cross-section of the passageway 42 and hence the flow increases. The arrangement of the V-grooves 46 permits accurate metering of the diluent and, particularly for carbonated water, reduces the risk of carbon dioxide breakout as it passes through the valve 38. Diluent flowing through the valve 38 is delivered to the mixing head 10 where it mixes with concentrate supplied to the mixing head 10 for dispense of the mixed beverage. The apparatus is arranged so that only one concentrate and one diluent are supplied to the mixing head 10 by opening the associated solenoid control valves and closing the other solenoid control valves. In this way, the mixing head 10 can supply eight different beverages, one at a time by appropriate control of the solenoid control valves to feed the required combination of diluent and concentrate for the selected beverage to the mixing head 10. The changeover valve means 32 is positioned close to the mixing head 10. In this way, the volume of diluent that remains between the valve means 32 and the head 10 after a dispense, is minimised. As a result, its mixing in with a subsequent beverage dispensed using the other diluent has little or no noticeable effect.

A control panel 50 is provided for user selection of a desired beverage and is connected to a programmed control board 52 for controlling the various valves to deliver the required combination of concentrate and diluent to the mixing head 10. The control panel 50 may be of any suitable type such as a keypad for the user to select and input the required type of beverage. The control board 52 is connected to each of the solenoid control valves 22, 24, 26, 28 for the concentrate and each of the solenoid control valves 34 and 36 for the diluent. The control board 52 is operable in response to selection of a particular beverage at the control panel 50 to open the appropriate valves for feeding each constituent of the ordered beverage to the mixing head 10. The control board 52 is also connected to the V-groove valve 38 and to pumping means (not shown) for each of the beverage constituents to allow the required amount of flow of each constituent to be pumped to the mixing head 10 for dispense of the mixed beverage at outlet 12. As is well understood in the art, there exists a predetermined desired ratio to be maintained between the diluent water and syrup concentrate to produce a drink having the desired taste characteristics. Flow meters 54, electrically connected to provide flow rate data to control board 52, may be provided in each of the flow lines whereby each valve may be automatically closed after the required amount of flow of diluent and concentrate has been registered at the control board 52.

As will now be appreciated, the changeover valve means 32 enables carbonated or still water to be selectively supplied to the mixing head 10 in the same flow line 30. In this way, the need for and expense of an individual diluent control valve, valve adjustment means and, where required, a flow meter for each diluent can be avoided. It will be understood, however, that the invention is not limited to the embodiment above described. For example, various alternative arrangements for controlling the supply of diluent to the mixing head may be employed. FIGS. 3 to 8 show alternate embodiments or arrangements of the invention herein. For convenience and ease of understanding, like reference numerals are used to indicate the same corresponding parts in each figure.

In FIG. 3, the V-groove valve 38 of the first embodiment is replaced by an on-off valve 60 which may be a solenoid valve. Flow of the required amount of diluent to the mixing head 10 may be controlled by a flow meter 54 in the flow line 30.

Figure 4:
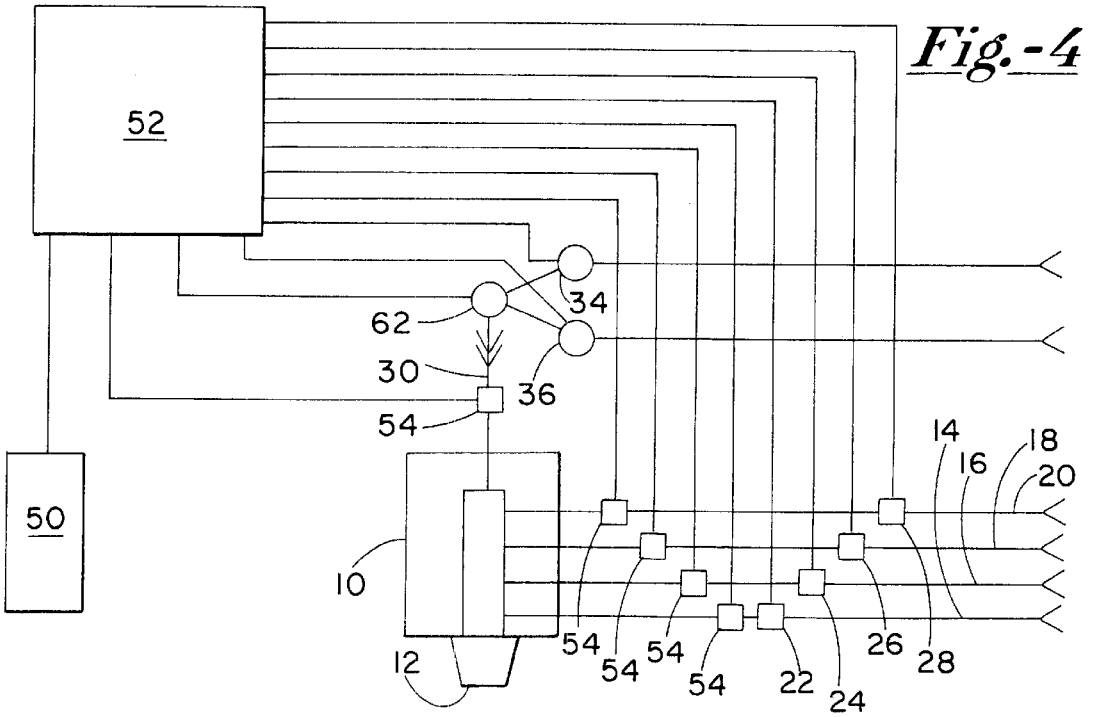
FIG. 4 shows a diagrammatic representation of a third embodiment of the present invention.

In FIG. 4, the V-groove valve 38 of the first embodiment is replaced by a modulating flow control valve 62 such as a modulating solenoid valve. Flow of the required amount of diluent to the mixing head 10 may be controlled by timing a metered flow of the diluent and/or by a flow meter 54 in the flow line 30.

Figure 5:
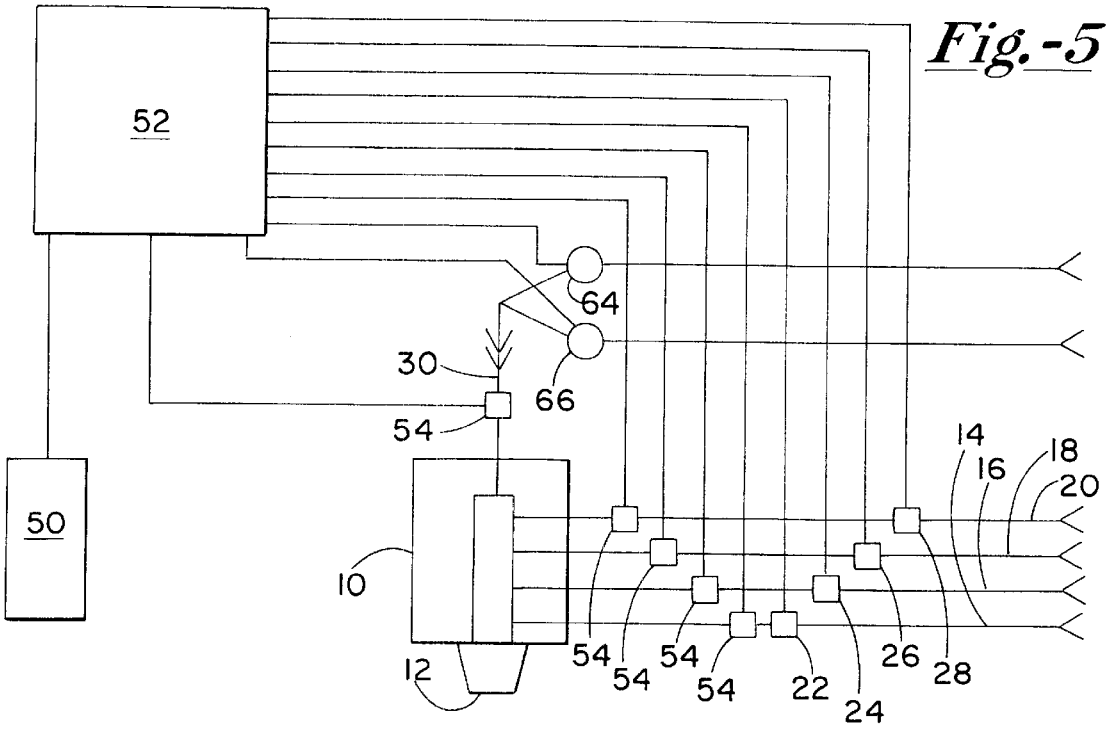
FIG. 5 shows a diagrammatic representation of a fourth embodiment of the present invention.

In FIG. 5, the V-groove valve 38 of the first embodiment is omitted and the on/off solenoid valves 34, 36 of the changeover valve means 30 replaced by modulating flow control valves 64, 66 such as modulating solenoid valves. The valves 64, 66 meter the flow of diluent for timed flow of the required amount of diluent to the mixing head 10. Alternatively, the on/off solenoid valves 34, 36 may be retained and flow of the required amount of diluent to the mixing head 10 controlled by a flow meter 54 in flow line 30.

Figure 6:
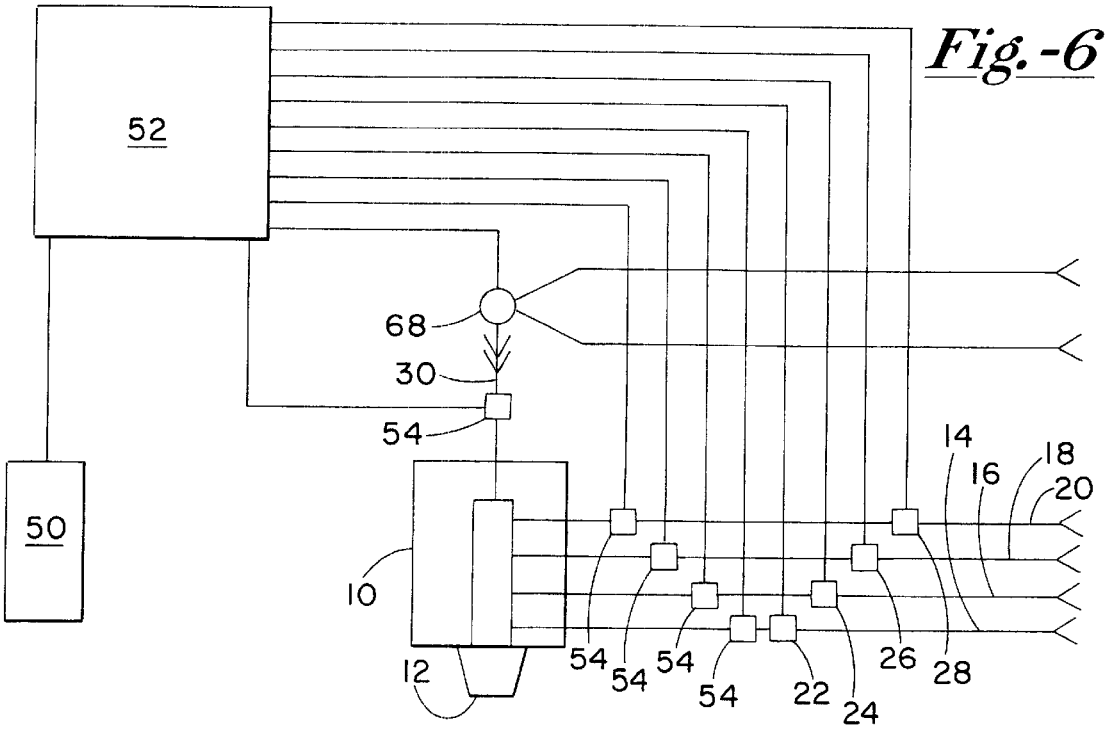
FIG. 6 shows a diagrammatic representation of a fifth embodiment of the present invention.

In FIG. 6, the on/off solenoid valves 34, 36 are combined in a single changeover valve 68 connected to the sources of diluent and to the flow line 30. The valve 68 may provide simple on/off control of flow of the selected diluent with a flow meter 54 being provided in the flow line to control flow of the required amount of diluent to the mixing head 10. Alternatively, modulating flow may be provided by incorporating a V-groove or other modulating flow arrangement in the changeover valve or by a separate valve between the changeover valve and the mixing head as in the first embodiment for timed flow of the required amount of diluent to the mixing head 10.

Figure 7:
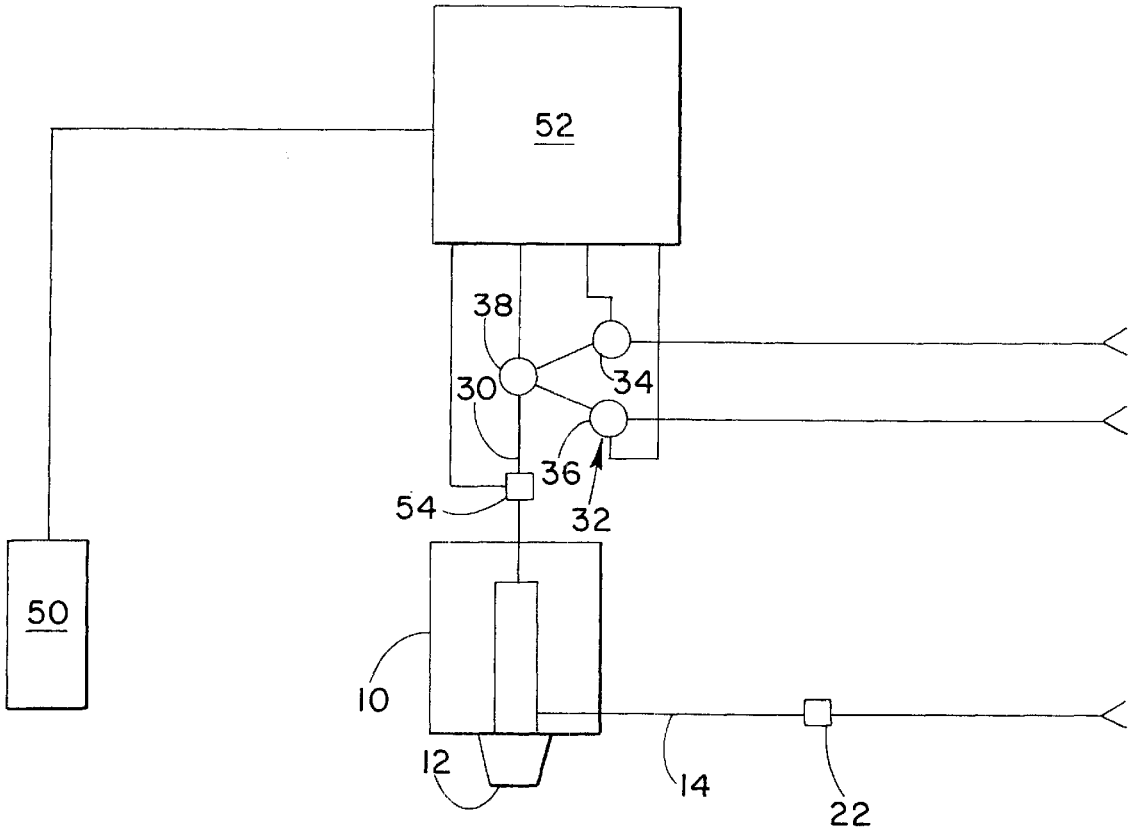
FIG. 7 shows a diagrammatic representation of a sixth embodiment of the present invention.

In FIG. 7, the mixing head 10 is connected to a single source of concentrate via flow line 14 whereby the apparatus can dispense either one of two post-mix beverages in which the concentrate is mixed with either still or carbonated water selected by the user via the control panel 50.

Figure 8:
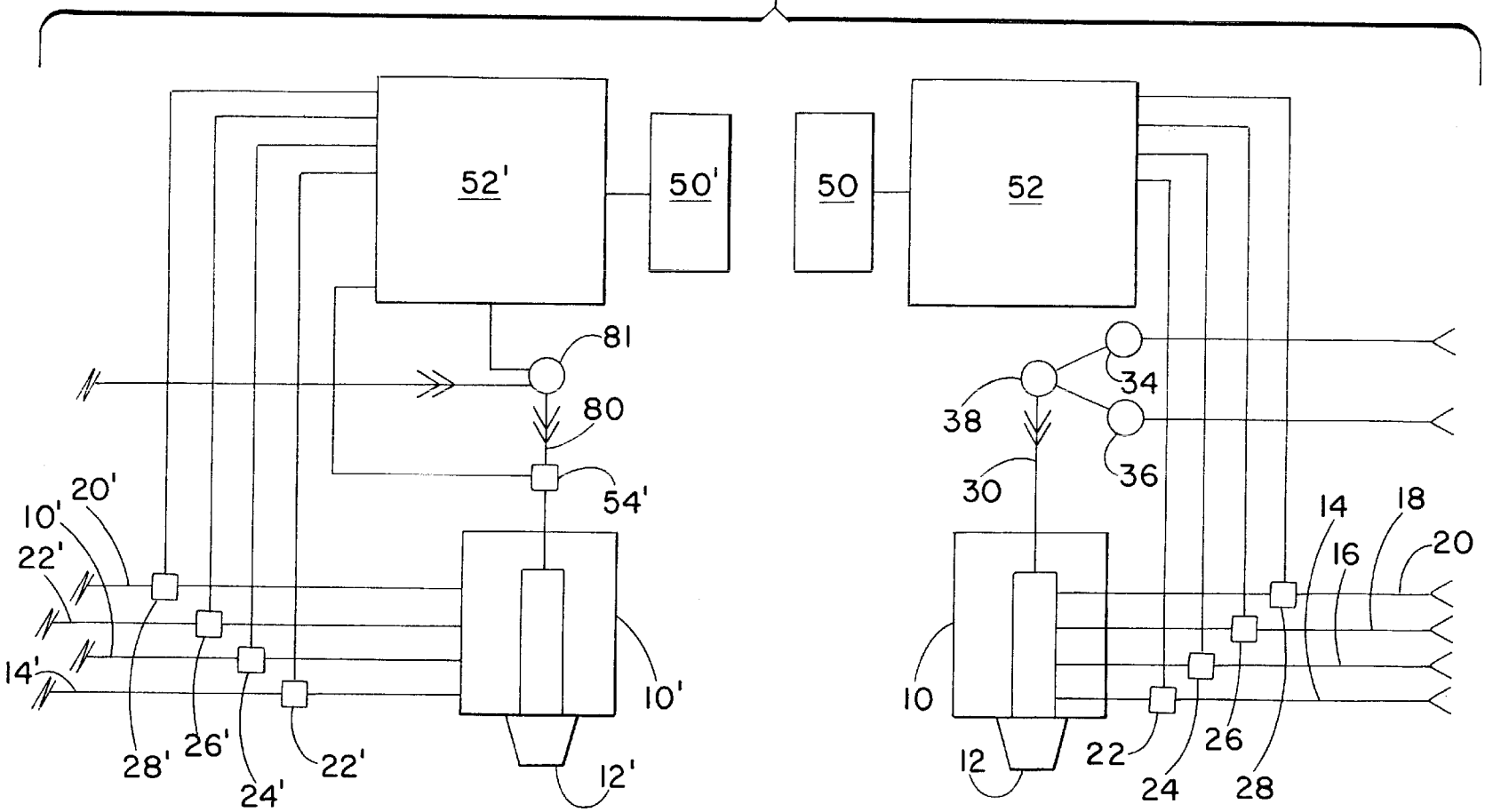
FIG. 8 shows diagrammatic representation of a seventh embodiment of the present invention.

In FIG. 8, the apparatus has two mixing heads 10, 10'. One of the mixing heads 10 is of the type already described for selectively mixing still or carbonated water with a concentrate for delivery of a desired beverage at outlet 12. The other head 10' is connected to a dedicated supply of carbonated water in flow line 80 under the control of a valve 81 for mixing with a selected concentrate delivered to the head 10 in dedicated flow lines 14', 16', 18', 20' to provide a carbonated beverage at outlet 12'. Valve 81 may be an on/off solenoid valve with a flow meter 54' in the flow line 80 to dispense the required amount of water. Alternatively, the valve 81 may be a modulating valve for controlled dispense of the required amount of water. Alternatively, a separate modulating valve may be provided in the flow line 80. The head 10' may have its own control panel 50' and control board 52'.

Other valve arrangements for controlling the flow of diluent to the mixing head will be apparent to those skilled in the art and are deemed within the scope of the invention. It will also be appreciated that the invention is not limited to the particular valves described herein. For example, the on/off solenoid valves may be replaced by any other type of on/off valve operable by any suitable mechanism that is preferably fail safe to close the valve if a fault occurs. Similarly, where provided the V-groove valve for controlling flow may be replaced by any other appropriate type of valve operable by any suitable mechanism. Additionally, while the invention has been described to provide post-mix beverages in which the selected beverage is obtained by mixing either still or carbonated water with the appropriate concentrate, it will be understood that the changeover valve means may be used to provided a post-mix beverage containing a mixture of still and carbonated water. Moreover, the invention has been described in apparatus using still and carbonated water as the diluents for convenience and it will be apparent to those skilled in the art that the invention has wider application for use with any type of diluent to obtain a desired post-mix beverage. It can also be appreciated that the change over valve of the present invention is not necessarily limited to the dispense of potable beverages. The present invention could have utility for the mixing a wide range of diluents with a further wide range of concentrates regardless if such concentrates or diluents are consumable or not.

Furthermore, it will also be understood that the exemplary embodiments described herein are intended to illustrate the diverse range and application of the invention and that features of the embodiments may be employed separately or in combination with any other features of the same or different embodiments to produce any desired post mix beverage apparatus.

Moreover, while the specific constructions and/or configurations of the post mix beverage apparatus described and illustrated are believed to represent the best means currently known to the applicant, it will be understood that the invention is not limited thereto and that various modifications and improvements can be made within the spirit and scope of the claims.

What is claimed is:

1. A dispensing device for mixing one or more concentrates with two or more diluents, comprising:

one or more concentrate lines providing for separate fluid connection between corresponding individual one or more pressurized sources of concentrate and corresponding one or more concentrate control valves, and the concentrate control valves individually fluidly connected to separate concentrate outlets in a dispensing head, two or more diluent lines providing for separate fluid connection between corresponding individual two or more pressurized sources of diluent and separate two or more inlets of a change over valve mechanism, the change over valve mechanism having a single diluent outlet for fluid connection to a common diluent line, a control valve having an inlet fluidly connected to the common diluent line and an outlet fluidly connected to a separate diluent outlet of the dispensing head, a closure member operated by a drive means and movable thereby in a passageway of the control valve to a plurality of positions between the inlet and the outlet thereof from a first position in which the valve is fully closed to a second position in which the valve is fully open, a wall of the passageway of the closure member defining at least one groove, the groove having a transverse cross-section that increases in area in a downstream direction wherein diluent flows through the passageway from the control valve inlet to the control valve outlet, and the movement of the closure member from the first closed position towards the second open position opens a flow channel through the groove of increasing size, a control for regulating the operation of the one or more concentrate control valves, the change over valve mechanism and the drive means of the control valve for controlling dispensing from the dispensing head of various mixtures of the one or more concentrates with the two or more diluents and for controlling the flow rate of the selected diluent.

2. The dispensing device as defined in claim 1, and the change over valve mechanism comprising two or more diluent valves individually connected to one of the two or more diluents lines and all connected on outlets thereof to the common diluent line.

3. The dispensing device as defined in claim 1, and each of the two or more diluent lines including a flow sensor and connected to the control so that a flow rate of a diluent as it flows through its respective diluent line can be determined for regulating the operation of the drive means of the control valve accordingly to maintain a desired volumetric ratio between a a concentrate and a diluent.

4. The dispensing device as defined in claim 1, and each of the one or more concentrate lines including a flow sensor electrically connected to the control so that the flow rate of a concentrate as if flows through its respective concentrate line can be determined for regulating the operation of the drive means of the control valve accordingly to maintain a desired volumetric ratio between a concentrate and a diluent.

5. The dispensing device as defined in claim 1, and each of the two or more diluent lines including a flow sensor and connected to the control so that a flow rate of a diluent as it flows through its respective diluent line can be determined, and each of the one or more concentrate lines including a flow sensor electrically connected to the control so that the flow rate of a concentrate as it flows through its respective concentrate line can be determined for regulating the operation of the drive means of the control valve accordingly to maintain a desired volumetric ratio between a concentrate and a diluent.

* * * * *

UNITED STATES PATENT AND TRADEMARK OFFICE

CERTIFICATE OF CORRECTION

PATENT NO. : 6,478,192 B2
DATED : November 12, 2002
INVENTOR(S) : Keith Heyes

It is certified that error appears in the above-identified patent and that said Letters Patent is hereby corrected as shown below:

Title page,
Please enter the following:
-- [30] Foreign Application Priority Data
Mar. 29, 2000 (GB) …….0007586.1 --

Signed and Sealed this

Fourth Day of November, 2003

JAMES E. ROGAN
*Director of the United States Patent and Trademark Office*